US008952778B2

(12) United States Patent
Sato et al.

(10) Patent No.: US 8,952,778 B2
(45) Date of Patent: Feb. 10, 2015

(54) LAMINATED COIL COMPONENT

(75) Inventors: Takahiro Sato, Tokyo (JP); Yuya Ishima, Tokyo (JP); Shusaku Umemoto, Tokyo (JP); Takashi Suzuki, Tokyo (JP); Satoru Okamoto, Tokyo (JP); Yoshikazu Sakaguchi, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 14/125,745

(22) PCT Filed: Aug. 20, 2012

(86) PCT No.: PCT/JP2012/070996

§ 371 (c)(1),
(2), (4) Date: Dec. 12, 2013

(87) PCT Pub. No.: WO2013/035516

PCT Pub. Date: Mar. 14, 2013

(65) Prior Publication Data

US 2014/0118100 A1 May 1, 2014

(30) Foreign Application Priority Data

Sep. 7, 2011 (JP) ..... 2011-194913

(51) Int. Cl.
*H01F 5/00* (2006.01)

(52) U.S. Cl.
USPC ..... 336/200

(58) Field of Classification Search
USPC ..... 336/200, 232, 206–208, 65, 83, 2, 234
See application file for complete search history.

(56) References Cited

U.S. PATENT DOCUMENTS 7,229,939 B2 6/2007 Nonoue et al.

FOREIGN PATENT DOCUMENTS

| | | |
|---|---|---|
| JP | A-7-82041 | 3/1995 |
| JP | A-10-65335 | 3/1998 |
| JP | A-11-297533 | 10/1999 |
| JP | A-2004-99378 | 4/2004 |
| JP | A-2005-286127 | 10/2005 |
| JP | A-2008-243738 | 10/2008 |

OTHER PUBLICATIONS

International Search Report issued in International Application No. PCT/JP2012/070996 on Nov. 20, 2012 (with translation).
International Preliminary Report on Patentability issued in International Application No. PCT/JP2012/070996 issued Mar. 12, 2014.

*Primary Examiner* — Tuyen Nguyen
(74) *Attorney, Agent, or Firm* — Oliff PLC

(57) ABSTRACT

In the laminated coil component, the grain diameter of the coil conductors is 10 μm to 22 μm after baking is completed. When the grain diameter of the coil conductors is set to be 10 μm or larger after baking is completed, surface roughness of the coil conductors can be reduced to such an extent that a satisfactory Q value can be obtained at a high frequency. In addition, when the grain diameter of the coil conductors is set to be 22 μm or smaller after baking is completed, metal of the coil conductors can be refrained from being rapidly melted down during baking. Accordingly, a high Q value can be obtained while a high quality is ensured.

4 Claims, 10 Drawing Sheets

*Fig.4*
(a)
CRYSTALLINE
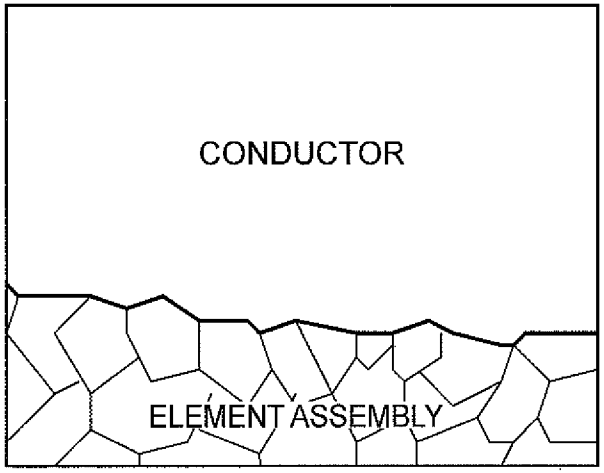
(b)
AMORPHOUS
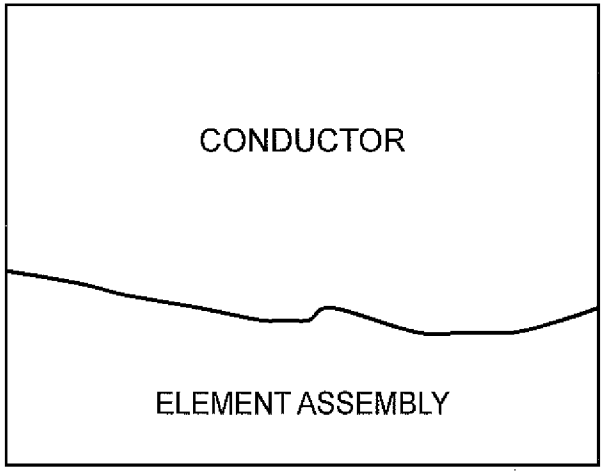

*Fig.7*

| | SURFACE ROUGHNESS | CONDUCTOR GRAIN DIAMETER | BAKING CONDITIONS | | BASE MATERIAL CHARACTERISTICS | ELECTRODE CHARACTERISTICS |
|---|---|---|---|---|---|---|
| | | | TEMPERATURE | TIME | | |
| A-1 | 1.34% | ∞ | 968°C | 14min | AMORPHOUS | EASY GRAIN GROWTH |
| A-2 | 0.88% | ∞ | 968°C | 14min | AMORPHOUS | EASY GRAIN GROWTH |
| A-3 | 2.93% | 21.9 μm | 955°C | 24hr | AMORPHOUS | EASY GRAIN GROWTH |
| A-4 | 3.79% | 18.9 μm | 955°C | 8hr | AMORPHOUS | EASY GRAIN GROWTH |
| A-5 | 3.91% | 15.7 μm | 968°C | 14min | AMORPHOUS | EASY GRAIN GROWTH |
| A-6 | 4.30% | 13.6 μm | 980°C | 1min | AMORPHOUS | EASY GRAIN GROWTH |
| A-7 | 5.51% | 10.4 μm | 915°C | 13min | AMORPHOUS | EASY GRAIN GROWTH |
| B-1 | 4.23% | 17.6 μm | 955°C | 3hr | AMORPHOUS | EASY GRAIN GROWTH |
| B-2 | 5.15% | 12.3 μm | 955°C | 3hr | AMORPHOUS | EASY GRAIN GROWTH |
| B-3 | 4.38% | 11.4 μm | 955°C | 3hr | AMORPHOUS | EASY GRAIN GROWTH |
| B-4 | 5.08% | 11.1 μm | 955°C | 3hr | AMORPHOUS | EASY GRAIN GROWTH |
| B-5 | 5.07% | 9.3 μm | 955°C | 3hr | AMORPHOUS | EASY GRAIN GROWTH |
| B-6 | 6.12% | 7.6 μm | 915°C | 1hr | AMORPHOUS | EASY GRAIN GROWTH |
| C-1 | 7.98% | 7.2 μm | 915°C | 60min | CRYSTALLINE | EASY GRAIN GROWTH |
| C-2 | 18.2% | 5.1 μm | 915°C | 60min | CRYSTALLINE | DIFFICULT GRAIN GROWTH |
| C-3 | 10.8% | 4.6 μm | 900°C | 20min | CRYSTALLINE | DIFFICULT GRAIN GROWTH |
| C-4 | 16.5% | 4.0 μm | 915°C | 60min | CRYSTALLINE | DIFFICULT GRAIN GROWTH |
| C-5 | 15.9% | 3.7 μm | 915°C | 15min | CRYSTALLINE | DIFFICULT GRAIN GROWTH |

*Fig.9*
(a)
SURFACE ROUGHNESS=1%
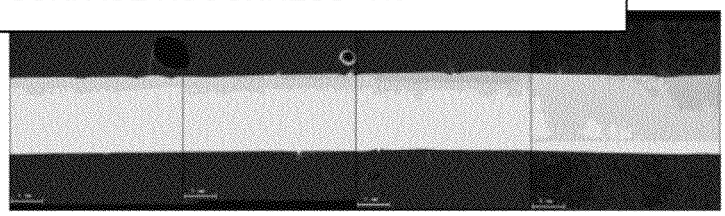
(b)
SURFACE ROUGHNESS=5%
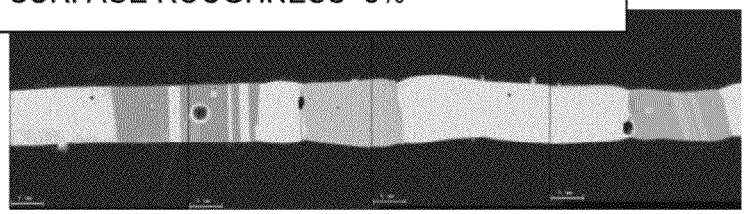
(c)
SURFACE ROUGHNESS= 8%
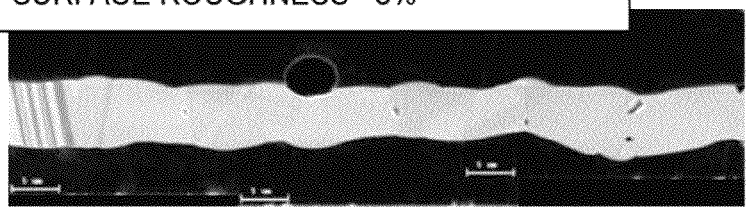
(d)
SURFACE ROUGHNESS=18%
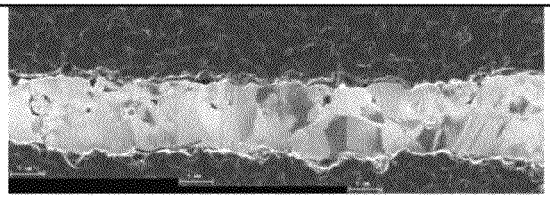

LAMINATED COIL COMPONENT

TECHNICAL FIELD

The present invention relates to a laminated coil component.

BACKGROUND ART

A laminated coil component in the related art is disclosed, for example, in Patent Literature 1. In the laminated coil component, a conductive pattern of a coil conductor is formed on a glass-ceramic sheet, each of the sheets is laminated, the coil conductors in the sheets are electrically connected with each other, the resultant body is baked, and thus, an element assembly is formed to have a coil unit arranged therein. In addition, external electrodes are formed on both end surfaces of the element assembly to be electrically connected with end portions of the coil unit.

CITATION LIST

Patent Literature

[Patent Literature 1] Japanese Unexamined Patent Application Publication No. 11-297533

SUMMARY OF INVENTION

Technical Problem

Herein, a laminated coil component has a low Q (quality factor) value compared to a wound coil obtained by winding wires due to reason such as the structure of the laminated coil component or a method of manufacturing the laminated coil component. However, as a component is required in recent years which can particularly cope with a high frequency, a high Q value is required even for a laminated coil component. A laminated coil component in the related art cannot achieve a Q value high enough to satisfy such a demand.

The present invention is made to solve such a problem, and an object of the present invention is to provide a laminated coil component which can show a high Q value.

Solution to Problem

Smoothness of the surface of a coil conductor is preferably improved to increase a Q value of a coil. When surface resistance of a coil conductor is large at a high frequency, a Q value cannot be increased due to a skin effect. When smoothness of the surface of a coil conductor is deteriorated, surface resistance is increased. The inventors find that, after baking is completed, the grain diameter of a conductor is preferably set to be in a predetermined range of size to improve smoothness of the surface of a coil conductor and thus to increase a Q value.

Specifically, the inventors find that, when the grain diameter of a coil conductor is set to be 10 μm or larger after baking is completed, surface roughness of the coil conductor can be reduced to such an extent that a satisfactory Q value can be obtained at a high frequency. On the other hand, the inventors find that, when the grain diameter of a coil conductor is set to be excessively large after baking is completed, metal of the coil conductor is rapidly melted down during baking, thereby causing an open circuit of the coil conductor, a pull-in of a lead-out portion, or the like. The inventors find that metal of a coil conductor can be refrained from being rapidly melted down by making the grain diameter of the coil conductor to be a target size of 22 μm or smaller after baking is completed.

A laminated coil component according to an aspect of the present invention includes an element assembly formed by laminating a plurality of insulation layers, and a coil unit formed inside the element assembly by a plurality of coil conductors. The grain diameter of the coil conductor is 10 μm to 22 μm after baking is completed.

In a laminated coil component according to the aspect of the present invention, when the grain diameter of a coil conductor is set to be 10 μm or larger after baking is completed, surface roughness of the coil conductor can be reduced to such an extent that a satisfactory Q value can be obtained at a high frequency. In addition, when the grain diameter of a coil conductor is set to be 22 μm or smaller after baking is completed, metal of the coil conductor can be refrained from being rapidly melted down during baking. Accordingly, a high Q value can be obtained while a high quality is ensured.

In addition, in a laminated coil component, an element assembly may be made from glass-ceramic. Accordingly, dielectric constant of the element assembly can be decreased and a Q value can be increased.

In addition, in a laminated coil component, the glass-ceramic may contain 86.7 weight % to 92.5 weight % of $SiO_2$ and 0.5 weight % to 2.4 weight % of $Al_2O_3$. When a composition of a glass-ceramic of an element assembly comes within such a range, smoothness of the surface of a coil conductor can be even more improved.

In addition, in a laminated coil component, a potassium coating layer may be formed to cover a coil conductor. When potassium is present around a coil conductor, a softening point of an element assembly around the coil conductor can be lowered, the region of the element assembly is softened and thus is prone to be smooth during baking. Accordingly, the surface of the coil conductor in contact therewith also can become smooth.

In addition, in a laminated coil component, the grain diameter of a coil conductor may be 11 μm to 18 μm after baking is completed. Accordingly, metal of the coil conductor can be even more refrained from being rapidly melted down, and surface roughness of the coil conductor can be even more reduced.

Advantageous Effects of Invention

According to the present invention, a Q value of a laminated coil component can be increased.

BRIEF DESCRIPTION OF DRAWINGS

FIG. 4 is a schematic diagram illustrating states of an element assembly during baking when a shape retention layer is included and not included therein while a softening point of a coil unit arrangement layer is low.

FIG. 7 is a table illustrating various conditions of the laminated coil component according to the example.

FIG. 9 shows photographs illustrating cross-sections of the coil conductors of the selected laminated coil component.

DESCRIPTION OF EMBODIMENTS

Hereinafter, preferred embodiments of a laminated coil component according to the present invention will be described with reference to the drawings.

Figure 1:
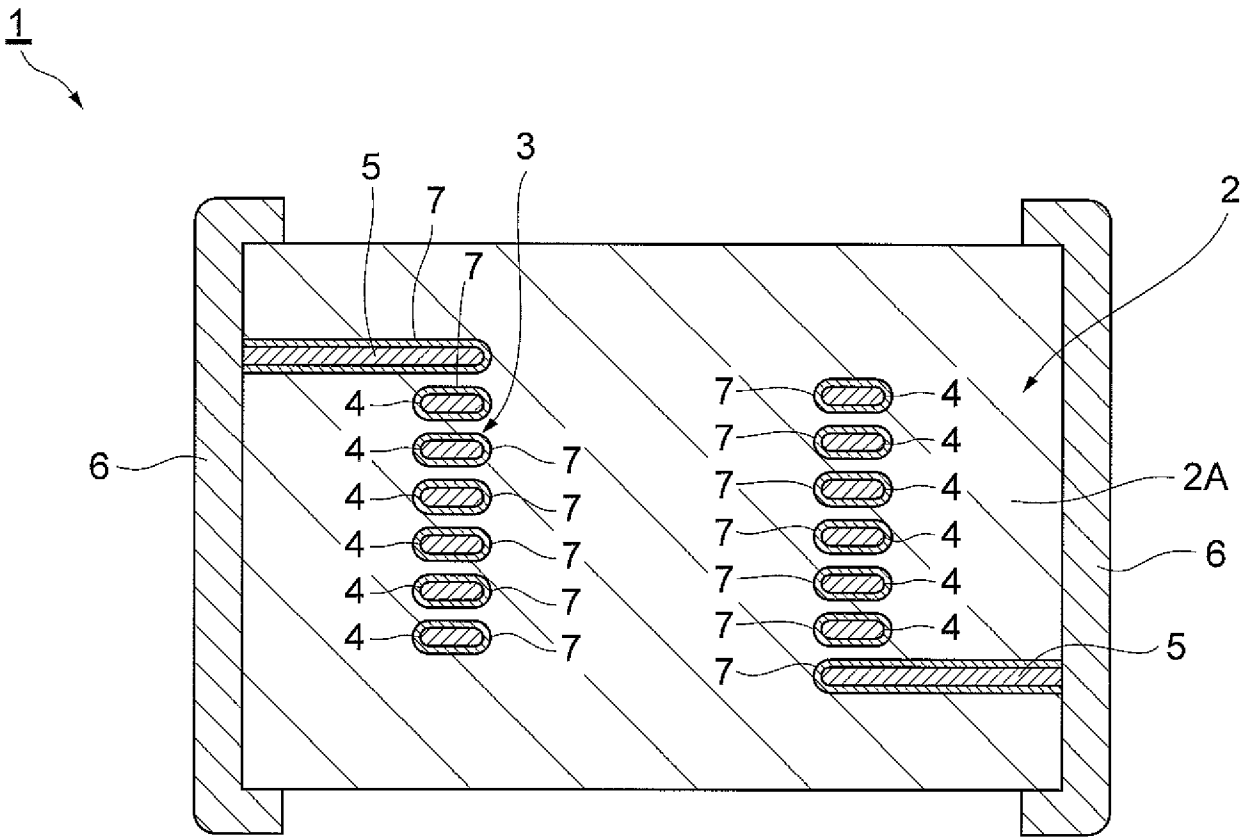
FIG. 1 is a cross-sectional view illustrating a laminated coil component according to an embodiment.
Figure 2:
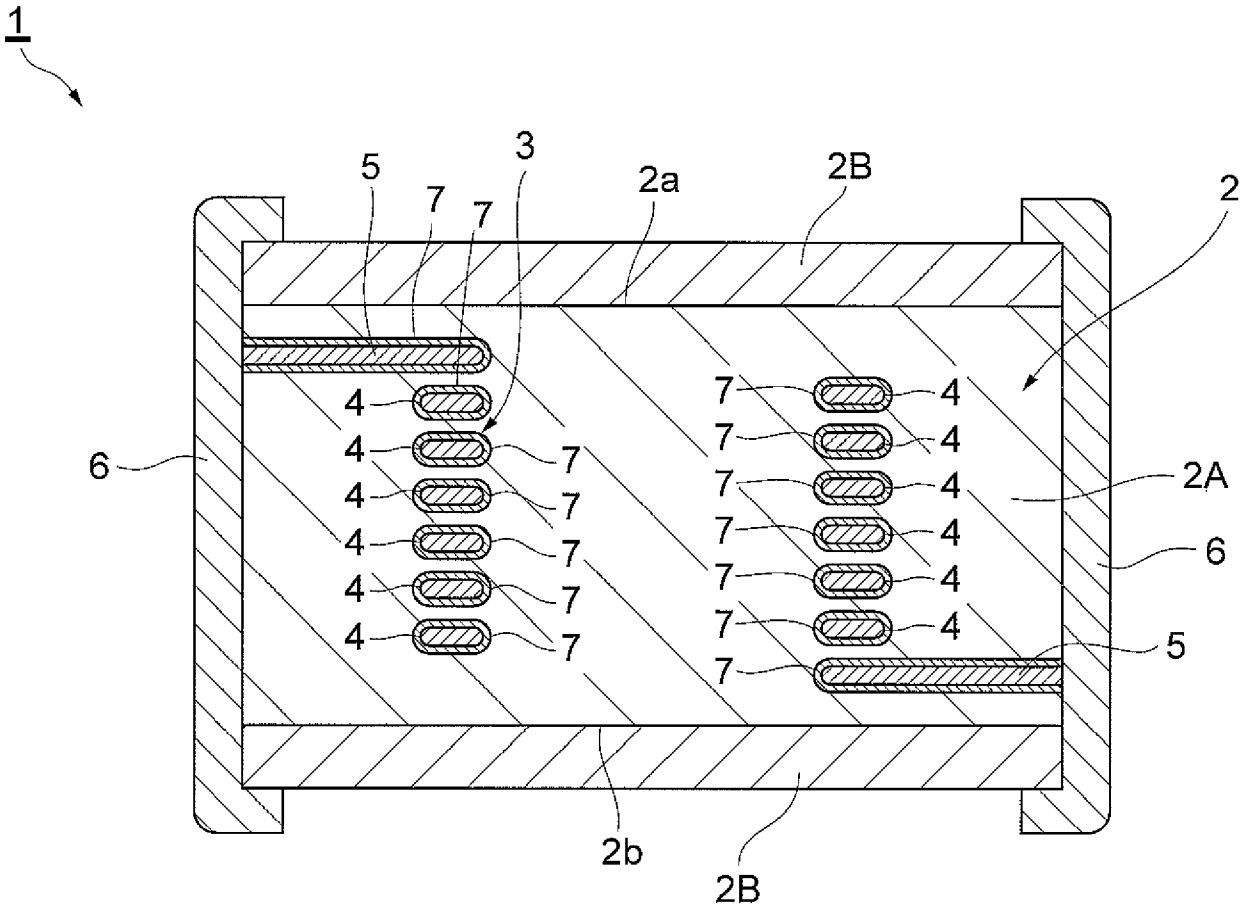
FIG. 2 is a cross-sectional view illustrating a laminated coil component according to another embodiment.

FIG. 1 and FIG. 2 are cross-sectional views illustrating laminated coil components according to the embodiments. As illustrated in FIG. 1 and FIG. 2, a laminated coil component 1 includes an element assembly 2 formed by laminating a plurality of insulation layers, a coil unit 3 formed inside the element assembly 2 by a plurality of coil conductors 4 and 5, and a pair of external electrodes 6 formed on both end surfaces of the element assembly 2.

The element assembly 2 is a rectangular parallelepiped or cubic laminated body which consists of a sintered body obtained by laminating a plurality of ceramic green sheets. Herein, as illustrated in FIG. 2, the element assembly 2 may be configured to include a coil unit arrangement layer 2A which has the coil unit 3 arranged therein and a pair of shape retention layers 2B which is provided to have the coil unit arrangement layer 2A interposed therebetween. Alternatively, as illustrated in FIG. 1, the element assembly 2 may be configured to have only the coil unit arrangement layer 2A without having the shape retention layer 2B.

The coil unit arrangement layer 2A is not particularly specified as far as the grain diameter of the coil conductor 4 can be within a predetermined range. However, for example, the coil unit arrangement layer 2A made from glass-ceramic is preferable. Accordingly, dielectric constant of the element assembly 2 can be decreased and a Q value can be increased. In addition, the coil unit arrangement layer 2A is preferably made from amorphous ceramics. Accordingly, smoothness of the coil conductors 4 and 5 can be improved. In addition, the coil unit arrangement layer 2A preferably contains $SiO_2$. Accordingly, dielectric constant of the coil unit arrangement layer 2A can be decreased. In addition, the coil unit arrangement layer 2A preferably contains $Al_2O_3$. Accordingly, crystal transition of the coil unit arrangement layer 2A can be prevented. In addition, since the coil unit arrangement layer 2A forms a coating layer 7 which covers the coil conductors 4 and 5, $K_2O$ is preferably contained.

The coil unit arrangement layer 2A contains, as main constituents, 35 weight % to 60 weight % of borosilicate glass, 15 weight % to 35 weight % of quartz and amorphous silica in the remainder, and contains alumina as an accessory constituent, and 0.5 weight % to 2.5 weight % of alumina is contained with respect to 100 weight % of the main constituents. After baking is completed, the coil unit arrangement layer 2A has a composition in which 86.7 weight % to 92.5 weight % of $SiO_2$, 6.2 weight % to 10.7 weight % of $B_2O_3$, 0.7 weight % to 1.2 weight % of $K_2O$ and 0.5 weight % to 2.4 weight % of $Al_2O_3$ are contained. When glass-ceramics contain 86.7 weight % to 92.5 weight % of $SiO_2$ and 0.5 weight % to 2.4 weight % of $Al_2O_3$, smoothness of the surfaces of the coil conductors 4 and 5 can be even more improved. MgO or CaO (1.0 weight % or less) may be contained.

Alternatively, the coil unit arrangement layer 2A contains, as main constituents, 35 weight % to 75 weight % of borosilicate glass, 5 weight % to 40 weight % of quartz and 5 weight % to 60 weight % of zinc silicate. Borosilicate glass contains, as main constituents, $SiO_2$=70 weight % to 90 weight % and $B_2O_3$=10 weight % to 30 weight % and contains, as accessory constituents, at least one or more type of constituents selected from $K_2O$, $Na_2O$, BaO, SrO, $Al_2O_3$ and CaO by a total of 5 weight % or less. After baking is completed, the coil unit arrangement layer 2A may have a composition containing $SiO_2$=53.7 weight % to 89.5 weight %, $B_2O_3$=3.5 weight % to 22.5 weight %, ZnO=3.0 weight % to 35.8 weight % and at least one or more type of constituents selected from $K_2O$, $Na_2O$, BaO, SrO, $Al_2O_3$ and CaO by a total of 3.8 weight % or less.

As illustrated in FIG. 2, when configured to have the shape retention layer 2B, the element assembly 2 is preferably configured as follows. The shape retention layer 2B is formed to entirely cover an end surface 2*a* and an end surface 2*b* facing each other in the laminating direction among end surfaces of the coil unit arrangement layer 2A. The shape retention layer 2B has a function of retaining a shape of the coil unit arrangement layer 2A during sintering. A thickness of the coil unit arrangement layer 2A is, for example, equal to or larger than 0.1 mm in the laminating direction, and a thickness of the shape retention layer 2B is equal to or larger than 5 μm in the laminating direction.

In the configuration as illustrated in FIG. 2, the coil unit arrangement layer 2A contains, as main constituents, 35 weight % to 60 weight % of borosilicate glass, 15 weight % to 35 weight % of quartz and amorphous silica in the remainder, and contains alumina as an accessory constituent, and 0.5 weight % to 2.5 weight % of alumina is contained with respect to 100 weight % of the main constituents. After baking is completed, the coil unit arrangement layer 2A has a composition containing 86.7 weight % to 92.5 weight % of $SiO_2$, 6.2 weight % to 10.7 weight % of $B_2O_3$, 0.7 weight % to 1.2 weight % of $K_2O$ and 0.5 weight % to 2.4 weight % of $Al_2O_3$. When the coil unit arrangement layer 2A contains 86.7 weight % to 92.5 weight % of $SiO_2$, dielectric constant of the coil unit arrangement layer 2A can be decreased. In addition, when the coil unit arrangement layer 2A contains 0.5 weight % to 2.4 weight % of $Al_2O_3$, crystal transition of the coil unit arrangement layer 2A can be prevented. MgO or CaO (1.0 weight % or less) may be contained.

The shape retention layer 2B contains, as main constituents, 50 weight % to 70 weight % of glass and 30 weight % to 50 weight % of alumina. After baking is completed, the shape retention layer 2B has a composition containing 23 weight % to 42 weight % of $SiO_2$, 0.25 weight % to 3.5 weight % of $B_2O_3$, 34.2 weight % to 58.8 weight % of $Al_2O_3$ and 12.5 weight % to 31.5 weight % of alkaline earth metal oxide, in which 60 weight % or more of the alkaline earth metal oxide (that is, 7.5 weight % to 31.5 weight % of the entirety of the shape retention layer 2B) is SrO.

In the configuration as illustrated in FIG. 2, a softening point of the coil unit arrangement layer 2A is set to be lower than a softening point or a melting point of the shape retention layer 2B. Specifically, a softening point of the coil unit arrangement layer 2A is 800 to 1,050° C., and a softening point or a melting point of the shape retention layer 2B is equal to or higher than 1,200° C. When a softening point of the coil unit arrangement layer 2A is lowered, the coil unit arrangement layer 2A can become amorphous. When a softening point or a melting point of the shape retention layer 2B is raised, a shape of the coil unit arrangement layer 2A having a low softening point is not deformed and can be retained during baking.

Since a softening point cannot be lowered when SrO is contained, SrO is not contained in the coil unit arrangement layer 2A. Herein, since SrO is difficult to diffuse, SrO of the shape retention layer 2B is refrained from diffusing to the coil unit arrangement layer 2A during baking. In addition, the coil unit arrangement layer 2A can contain $SiO_2$ having a relatively low dielectric constant by such an amount that is deficient in SrO, whereby dielectric constant can be decreased. Accordingly, a Q (quality factor) value of a coil can be increased. On the other hand, the shape retention layer 2B can contain less $SiO_2$ compared to the coil unit arrangement layer 2A by such an amount that SrO is contained, whereby dielectric constant is increased. However, the shape retention layer 2B does not contain the coil conductors 4 and 5 therein, and does not affect a Q value of a coil. In addition, the coil unit arrangement layer 2A has a large amount of $SiO_2$ and a low strength whereas the shape retention layer 2B has a small amount of $SiO_2$ and a high strength. The shape retention layer 2B can function as a reinforcement layer for the coil unit arrangement layer 2A after baking is completed.

Figure 5:
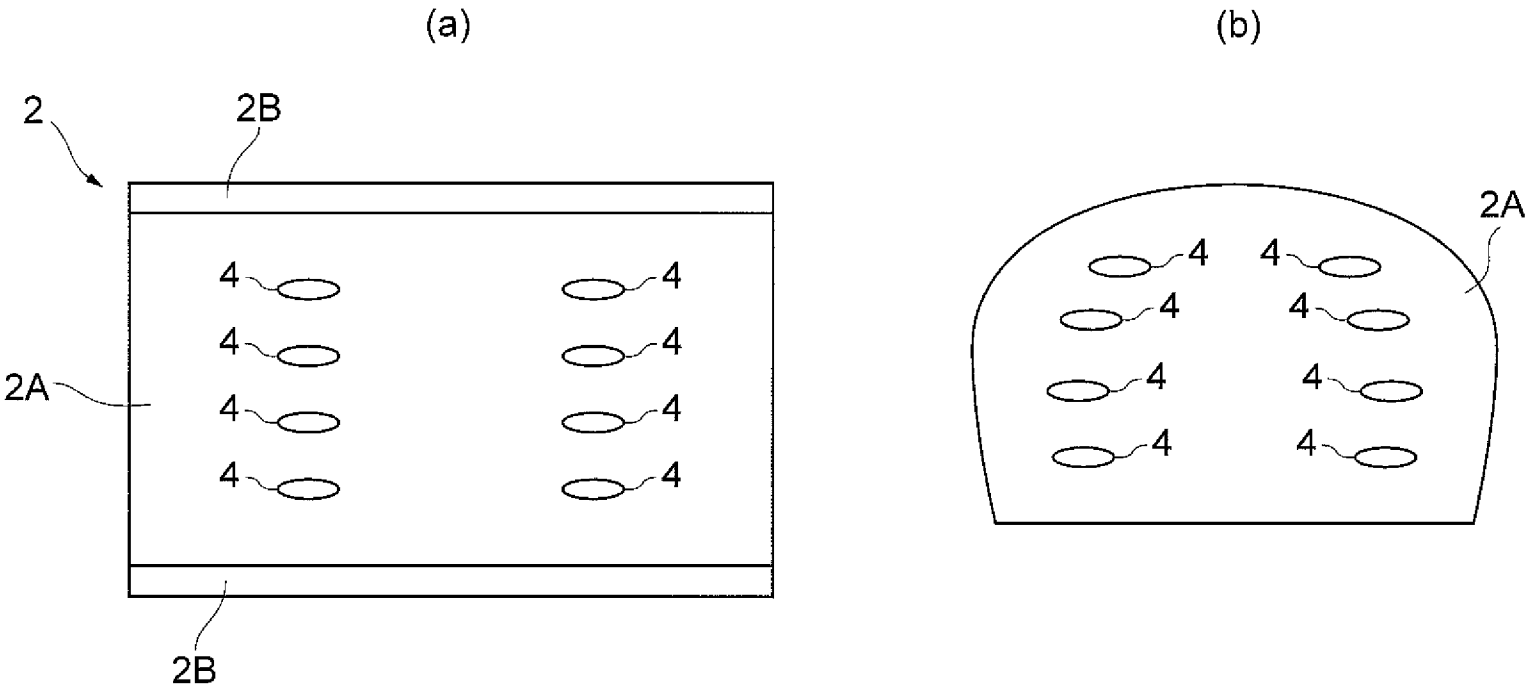
FIG. 5 is a schematic diagram illustrating a relation between a state of the element assembly and smoothness of the surface of the coil conductor.

Herein, when an element assembly is crystalline as illustrated in FIG. 4(*a*), there is a possibility that concavity and convexity of the surface of a coil conductor becomes large due to concavity and convexity of the surface of the element assembly in contact therewith. On the contrary, when an element assembly is amorphous, as illustrated in FIG. 4(*b*), the surface of a coil conductor more preferably becomes smooth due to a smooth surface of the element assembly in contact therewith. An element assembly more preferably becomes amorphous. In a configuration illustrated in FIG. 2 according to the embodiments, an element assembly is not entirely amorphous and includes a crystalline portion by such a small amount (0.5 weight % to 2.4 weight %) that alumina is contained. However, the amount is extremely small, and thus a smooth surface is obtained as illustrated in FIG. 4(*b*). On the other hand, when a softening point is lowered to make an element assembly amorphous, as illustrated in FIG. 5(*b*), the entirety of the element assembly is softened, and thus a shape of the element assembly becomes round and there is a case where the shape is not retained. However, the configuration having the shape retention layer 2B as illustrated in FIG. 2 is preferable since a shape of an element assembly can be retained as illustrated in FIG. 5(*a*). When the configuration of FIG. 2 is adopted, even though a softening point is set to be low compared to a softening point of the shape retention layer 2B to make the coil unit arrangement layer 2A amorphous, the coil unit arrangement layer 2A of which a softening point is lowered in this way is interposed between the shape retention layers 2B, and thus a shape of the coil unit arrangement layer 2A does not become round and is retained during baking. When an element assembly can become amorphous without having the shape retention layer 2B, such a configuration as in FIG. 1 may be adopted. In addition, an element assembly is not necessarily amorphous, and the element assembly may be crystalline as far as a desirable grain diameter of a coil conductor is obtained.

The coil unit 3 has the coil conductor 4 related to a winding pack and the coil conductor 5 related to a lead-out portion which is connected with the external electrode 6. The coil conductors 4 and 5 are formed by a conductive paste having, for example, any of silver, copper and nickel as a main constituent. In the configuration of FIG. 2, the coil unit 3 is arranged only inside the coil unit arrangement layer 2A and is not arranged in the shape retention layer 2B. In addition, none of the coil conductors 4 and 5 in the coil unit 3 are in contact with the shape retention layer 2B. Both end portions of the coil unit 3 in the laminating direction are apart from the shape retention layer 2B, the ceramic of the coil unit arrangement layer 2A is arranged between the coil unit 3 and the shape retention layer 2B. The coil conductor 4 related to a winding pack is configured by forming a conductive pattern having a predetermined winding by use of a conductive paste on the ceramic green sheet which forms the coil unit arrangement layer 2A. The conductive patterns of the layers are connected with each other via through-hole conductors in the laminating direction. In addition, the coil conductor 5 related to a lead-out portion is configured by a conductive pattern in such a manner that an end portion of a winding pattern is led out to the external electrode 6. A coil pattern of the winding pack, the number of windings, a lead-out position of the lead-out portion or the like is not particularly specified.

The K (potassium) coating layer 7 is formed around the coil conductors 4 and 5 of the coil unit 3 to cover the coil conductors 4 and 5. When potassium is contained in the ceramic green sheet which forms the coil unit arrangement layer 2A before baking is carried out, potassium is concentrated around the coil conductors 4 and 5 during baking, and thus the coating layer 7 is formed.

The grain diameter of the coil conductors 4 and 5 is preferably 10 μm to 22 μm after baking is completed, more preferably 11 μm to 18 μm. Surface roughness of the coil conductors 4 and 5 is preferably reduced to decrease surface resistance. When the grain diameter of the coil conductors 4 and 5 is set to be 10 μm or larger, surface roughness can be reduced to increase a Q value at a high frequency. In addition, when the grain diameter of the coil conductors 4 and 5 is set to be 22 μm or smaller, an open circuit, a pull-in of a lead-out portion or the like can be refrained from occurring due to the melting of metal (for example, silver) forming the coil conductors 4 and 5.

A pair of external electrodes 6 is formed to cover both end surfaces facing each other in a direction orthogonal to the laminating direction among end surfaces of the element assembly 2. Each of the external electrodes 6 is formed to entirely cover each of both end surfaces and a portion thereof may go around to other four surfaces from each of both end surfaces. Each of the external electrodes 6 is formed by screen-printing a conductive paste having, for example, any of silver, copper and nickel as a main constituent, or by a dip method.

Next, a method of manufacturing the laminated coil component 1 of the above-described configuration will be described.

First, ceramic green sheets forming the coil unit arrangement layer 2A are prepared. A ceramic paste is adjusted to have the above-described composition, is molded to have a sheet shape by a doctor blade method or the like, and each of the ceramic green sheets is prepared. In the configuration as illustrated in FIG. 2, ceramic green sheets forming the shape retention layer 2B also are prepared.

A conductive paste forming the coil conductors 4 and 5 is prepared. The conductive paste contains conducting powder having silver, nickel or copper as a main constituent and a predetermined grain size distribution. Specifically, conducting powder is used which has 1 μm to 3 μm of mean grain diameter and 0.7 μm to 1.0 μm of a standard deviation. Grain grading may be carried out to obtain conducting powder with such a grain size distribution.

Subsequently, each of the through-holes is formed by laser processing or the like at a predetermined position on each of the ceramic green sheets which become the coil unit arrangement layer 2A, that is, each of the through-holes is formed at a pre-arranged position where a through-hole electrode is formed. Next, each of the conductive patterns is formed on each of the ceramic green sheets which become the coil unit arrangement layer 2A. Herein, each of the conductive patterns and each of the through-hole electrodes are formed by a screen printing method using a conductive paste which contains silver, nickel or the like.

Subsequently, each of the ceramic green sheets is laminated. In the configuration as illustrated in FIG. 2, the ceramic green sheet which becomes the coil unit arrangement layer 2A is stacked on the ceramic green sheet which becomes the shape retention layer 2B, and the ceramic green sheet which becomes the shape retention layer 2B is stacked thereon. The shape retention layers 2B formed at a bottom portion and an upper portion may be formed by a piece of ceramic green sheet, or may be formed by a plurality of ceramic green sheets. Next, each of the ceramic green sheets is crimped by exerting pressure thereon in the laminating direction.

Subsequently, a laminated body is baked, for example, at 900 to 940° C. for 10 to 60 minutes to form the element assembly 2. Baking conditions are adjusted to have a target range of 10 μm to 22 μm for the grain diameter of a coil conductor. In the configuration as illustrated in FIG. 2, a set baking temperature is equal to or higher than a softening point of the coil unit arrangement layer 2A, and is set to be lower than a softening point or a melting point of the shape retention layer 2B. At this time, the shape retention layer 2B retains a shape of the coil unit arrangement layer 2A.

Subsequently, the external electrodes 6 are formed on the element assembly 2. Accordingly, the laminated coil component 1 is formed. An electrode paste, which has silver, nickel or copper as a main constituent, is coated on each of both end surfaces of the element assembly 2 in the longitudinal direction, baking is carried out at a predetermined temperature (for example, approximately 600 to 700° C.), and electroplating is carried out to form the external electrode 6. Cu, Ni, Sn and the like can be used for the electroplating.

Next, an operation and effect of the laminated coil component 1 according to the embodiments will be described.

Figure 3:
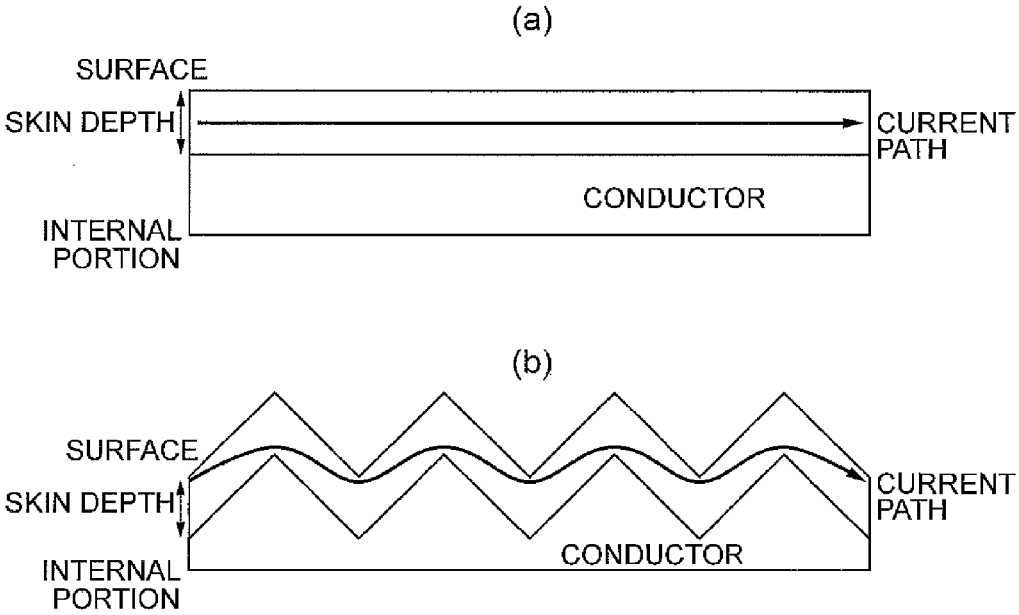
FIG. 3 is a schematic diagram illustrating a relation between smoothness of the surface and surface resistance of a coil conductor.

Smoothness of the surface of a coil conductor is preferably improved to increase a Q (quality factor) value of a coil. The higher a frequency becomes, the shallower skin depth becomes, and smoothness of the surface of a coil conductor affects a Q value at a high frequency. For example, when, as illustrated in FIG. 3(*b*), smoothness of the surface of a coil conductor is deteriorated and concavity and convexity are formed, surface resistance of the coil conductor is increased and a Q value of a coil is decreased. On the other hand, when smoothness of the surface of a coil conductor is improved as illustrated in FIG. 3(*a*), surface resistance of the coil conductor is decreased and a Q value of a coil can be increased.

Herein, the inventors find that, when the grain diameter of a coil conductor is set to be 10 μn or larger after baking is completed, surface roughness of the coil conductor can be reduced to such an extent that a satisfactory Q value can be obtained at a high frequency. On the other hand, the inventors find that, when the grain diameter of a coil conductor after baking is completed is set to be excessively large by the adjustment of baking conditions or the like, metal of the coil conductor is rapidly melted down during baking, thereby causing an open circuit of the coil conductor, a pull-in of a lead-out portion, or the like. The inventors find that metal of a coil conductor can be refrained from being rapidly melted down by aiming to set the grain diameter of the coil conductor to be 22 μm or smaller after baking is completed.

Accordingly, in the laminated coil component 1 according to the embodiments, the grain diameter of the coil conductors 4 and 5 is 10 μm to 22 μM after baking is completed. When the grain diameter of the coil conductors 4 and 5 is set to be 10 μM or larger after baking is completed, surface roughness of the coil conductors 4 and 5 can be reduced to such an extent that a satisfactory Q value can be obtained at a high frequency. In addition, when the grain diameter of the coil conductors 4 and 5 is set to be 22 μm or smaller after baking is completed, metal of the coil conductors 4 and 5 can be refrained from being rapidly melted down during baking. Accordingly, a high Q value can be obtained while a high quality is ensured.

In addition, in the laminated coil component 1, the potassium coating layer 7 is formed to cover the coil conductors 4 and 5. When potassium is present around the coil conductors 4 and 5, a softening point of the element assembly 2 around the coil conductors 4 and 5 can be lowered, the region of the element assembly 2 is softened and thus is prone to be smooth during baking. Accordingly, the surface of the coil conductors 4 and 5 in contact therewith also can become smooth. In addition, the coil conductors 4 and 5 are covered and protected by the potassium coating layer 7, whereby cracks can be prevented from occurring near the boundary between the coil conductors 4 and 5, and glass-ceramics.

The present invention is not limited to the above-described embodiments.

For example, in the above-described embodiments, a laminated coil component having one coil unit is illustrated. However, for example, a laminated coil component may have a plurality of coil units in an array.

EXAMPLE

Laminated coil components A-1 to A-7 (group A), laminated coil components B-1 to B-6 (group B) and laminated coil components C-1 to C-5 (group C) are manufactured, and a relation between conductor diameter and surface roughness of a coil conductor of each of the laminated coil components is investigated. In addition, a relation between surface roughness and an AC resistance value is investigated, and states of the coil conductors are observed.

<Manufacturing Conditions (Group A)>

The laminated coil components of the group A have, as illustrated in FIG. 2, a structure in which the coil unit arrangement layer 2A is interposed between the shape retention layers 2B.

A composition of a ceramic paste forming the coil unit arrangement layers 2A of the laminated coil components A-1 to A-7 has 66.1 weight % of borosilicate glass, 25.4 weight % of quartz, 8.5 weight % of zinc silicate, 10 weight % of ethylcellulose (binder) and 140 weight % of terpineol (solvent).

A composition of a ceramic paste forming the shape retention layers 2B of the laminated coil components A-1 to A-7 has 70 weight % of glass, 30 weight % of alumina, 10 weight % of ethylcellulose (binder) and 140 weight % of terpineol (solvent).

A composition of a conductive paste forming the coil conductors 4 and 5 of the laminated coil components A-1 to A-7 has 100 weight % of Ag, 10 weight % of ethylcellulose (binder) and 40 weight % of terpineol (solvent).

Baking conditions are set to the conditions illustrated in a table of FIG. 7.

In the laminated coil components A-1 to A-7 described above, base material characteristics become amorphous and electrode characteristics become easy grain growth.

<Manufacturing Conditions (Group B)>

The laminated coil components of the group B have, as illustrated in FIG. 2, a structure in which the coil unit arrangement layer 2A is interposed between the shape retention layers 2B.

A composition of a ceramic paste forming the coil unit arrangement layers 2A of the laminated coil components B-1 to B-6 has 60 weight % of borosilicate glass, 20 weight % of quartz, 20 weight % of amorphous silica, 1.5 weight % of alumina, 10 weight % of ethylcellulose (binder) and 140 weight % of terpineol (solvent).

A composition of a ceramic paste forming the shape retention layers 2B of the laminated coil components B-1 to B-6 has 70 weight % of glass, 30 weight % of alumina, 10 weight % of ethylcellulose (binder) and 140 weight % of terpineol (solvent).

A composition of a conductive paste forming the coil conductors 4 and 5 of the laminated coil components B-1 to B-6 has 100 weight % of Ag, 10 weight % of ethylcellulose (binder) and 40 weight % of terpineol (solvent).

Baking conditions are set to the conditions illustrated in a table of FIG. 7.

In the laminated coil components B-1 to B-6 described above, base material characteristics become amorphous and electrode characteristics become easy grain growth.

<Manufacturing Conditions (Group C)>

The laminated coil components of the group C have, as illustrated in FIG. 1, a structure including only the coil unit arrangement layer 2A.

A composition of a ceramic paste forming the coil unit arrangement layers 2A of the laminated coil components C-1 to C-5 has 70 weight % of glass, 30 weight % of alumina, 10 weight % of ethylcellulose (binder) and 140 weight % of terpineol (solvent).

A composition of a conductive paste forming the coil conductors 4 and 5 of the laminated coil components C-1 to C-5 has 100 weight % of Ag, 10 weight % of ethylcellulose (binder) and 40 weight % of terpineol (solvent).

Baking conditions are set to the conditions illustrated in a table of FIG. 7.

In the laminated coil components C-2 to C-5 described above, base material characteristics become crystalline and electrode characteristics become difficult grain growth. On the other hand, in the laminated coil components C-1, base material characteristics become crystalline and electrode characteristics become easy grain growth.

<Measurement of Conductor Grain Diameter and Surface Roughness>

Figure 6:
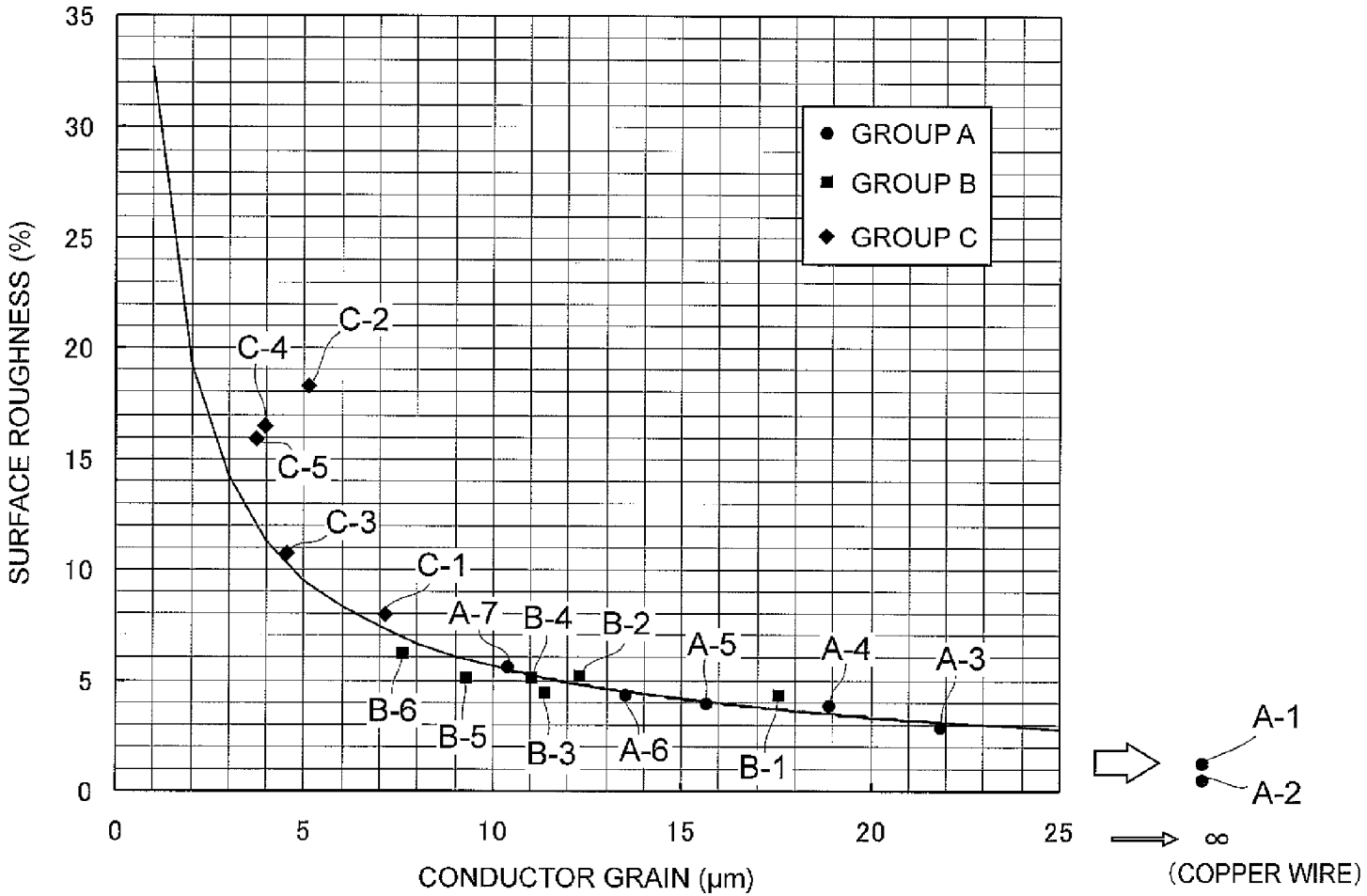
FIG. 6 is a graph illustrating a relation between a conductor diameter and surface roughness of a coil conductor of a laminated coil component according to an example.

Conductor grain diameter and surface roughness of the above-described laminated coil components are measured. A relation between the conductor grain diameter and the surface roughness is plotted on a graph illustrated in FIG. 6. A Scanning Ion Microscopy (SIM) image of the fracture surface of a conductor is captured, the area of a grain is calculated using image analysis software, and the diameter of a circle equivalent to the area is taken as a conductor grain diameter. In the surface roughness, the height and the width of concavity and convexity of a coil conductor are measured in the boundary portion of the fracture surface of the conductor between the coil conductor and an element assembly, a ratio of the height of the concavity and convexity to the width thereof is acquired in percentage, 100 or more of the concavities and convexities are sampled and the acquired percentages are statistically processed, and an average value of the percentages is taken as the surface roughness.

<Measurement of AC Resistance Value>

Figure 8:
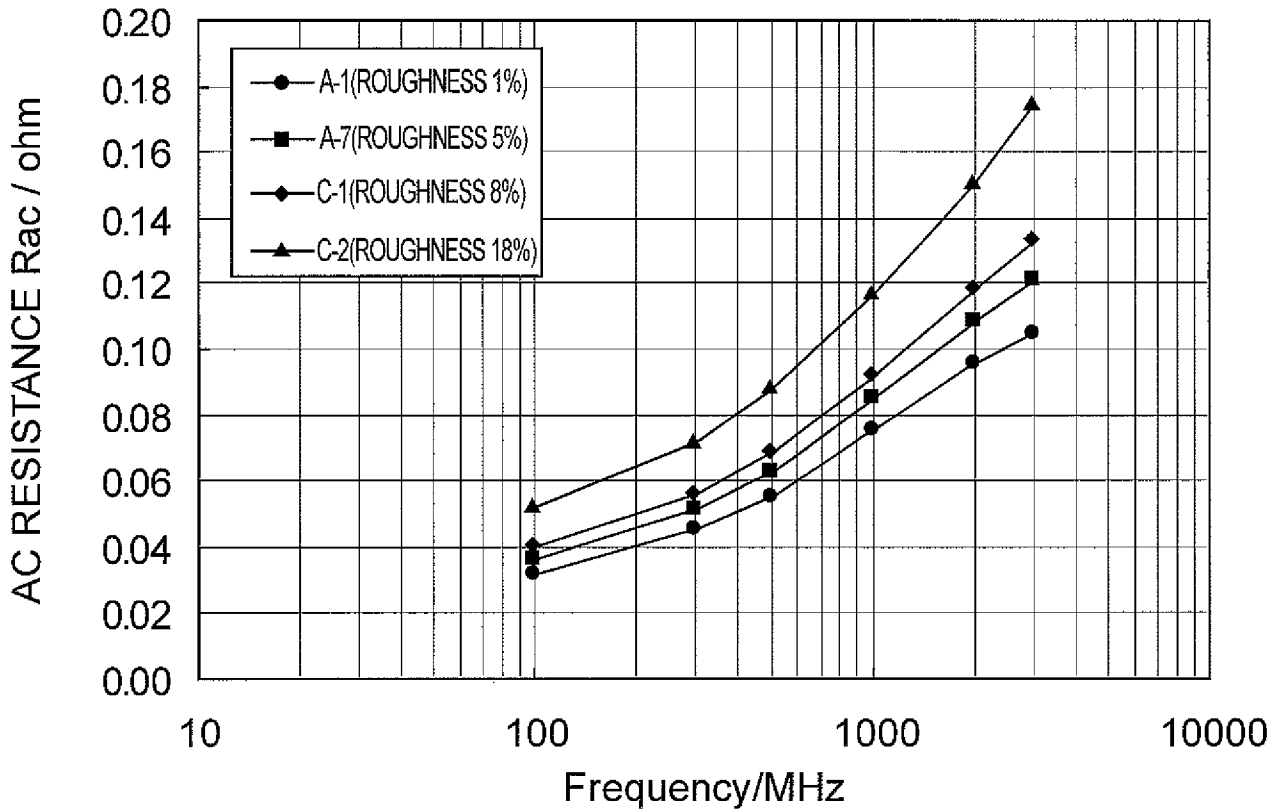
FIG. 8 is a graph illustrating a relation between a frequency and an AC resistance value of a selected laminated coil component.
Figure 10:
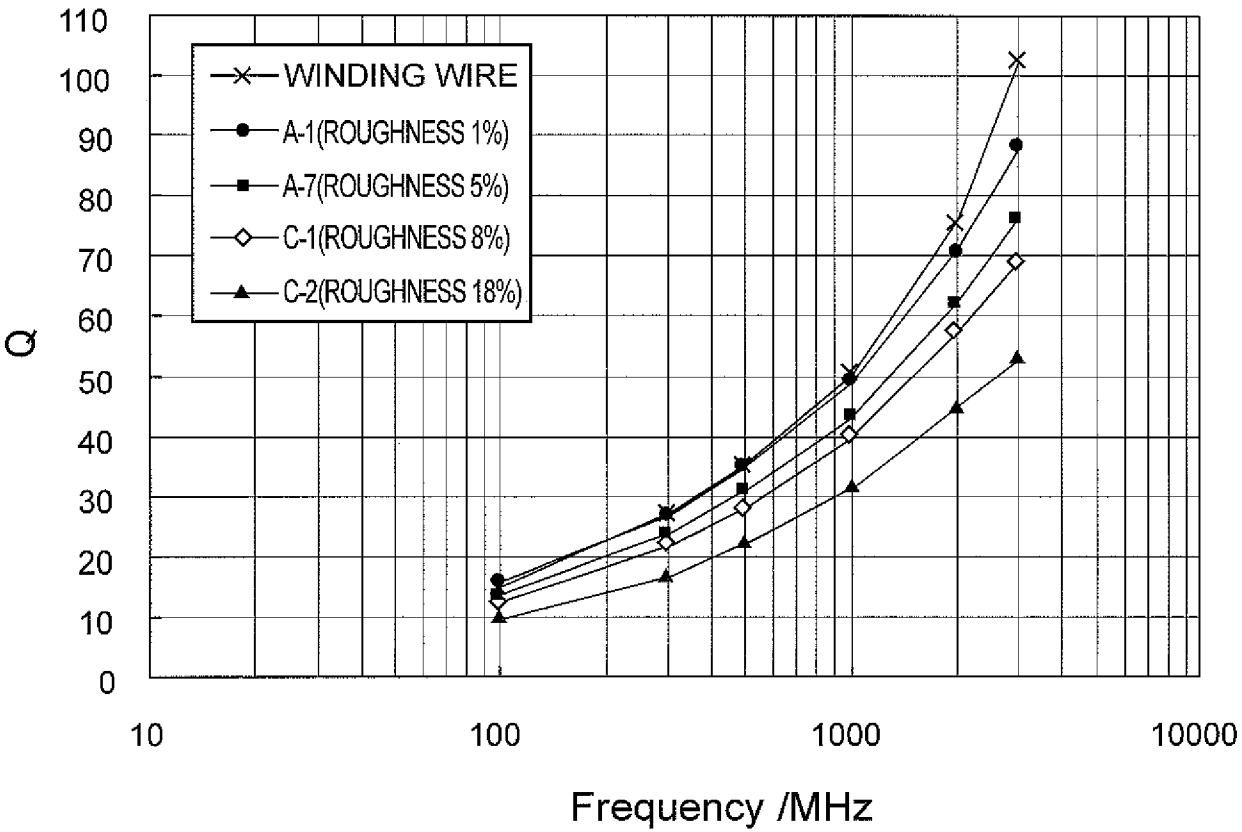
FIG. 10 is a graph illustrating a relation between a frequency and a Q value of the selected laminated coil component.

The laminated coil components A-1, A-7, C-1 and C-2 are picked up among the laminated coil components in FIG. 7, and AC resistance values thereof are measured. The perimeter of a conductor is 155 μm in each of the laminated coil components, and an AC resistance value per unit of μm is measured. The measurement results are illustrated in FIG. 8. In addition, FIG. 9 shows photographs of the fracture surface of a conductor in each of the laminated coil components. Furthermore, FIG. 10 illustrates Q values calculated from the AC resistance values illustrated in FIG. 8. As illustrated in FIG. 10, the laminated coil component C-1 (and A-1 and A-7 with smaller surface roughness than C-1) with approximately 8% of surface roughness can obtain approximately 80% of Q value of a winding coil at 1 GHz. It is understood that, when surface roughness is equal to or smaller than 8%, performance can be obtained with such a level that a satisfactory function can be achieved even for use in the same circuit in place of a winding coil. In addition, according to FIG. 8, the laminated coil component C-2 with approximately 18% of surface roughness has a high AC resistance value. On the other hand, in the laminated coil component A-7 with approximately 5% of surface roughness and the laminated coil component A-1 with approximately 1% of surface roughness, AC resistance values are further reduced than the AC resistance value of the laminated coil component C-1. As such, when surface roughness becomes a sufficiently small value, that is, a value equal to or smaller than 6% as in the laminated coil components A-1 and A-7, an AC resistance value can be reduced, whereby a Q value can be increased. It is understood from FIG. 6 that, when the grain diameter of a conductor is at least equal to or larger than 10 μm, surface roughness can be kept a sufficiently small value, that is, a value equal to or smaller than 6%, and a product with a high Q value can be reliably obtained.

<Observation of a State of Coil Conductor>

Next, in each of the laminated coil components, a state of a coil conductor is observed for an open circuit, a pull-in of a lead-out portion due to the melting of metal. In this observation, 100 pieces of laminated coil components are manufactured according to each condition and observed, respectively. In the laminated coil components A1 and A2, 100 out of 100 pieces of laminated coil components show an open circuit or the like. On the other hand, in the laminated coil components according to other conditions, such a open circuit or the like is not observed and a good state is shown in 100 out of 100 pieces of laminated coil components. It is understood from the results that, when the grain diameter of a coil conductor is equal to or smaller than 22 μm, the coil conductor can be refrained from being rapidly melted down, thereby preventing an open circuit or the like.

<Comprehensive Evaluation>

It is understood from the above results that, when the grain diameter of a coil conductor is made to have a target range of 10 μm to 22 μm, a high Q value can be obtained even at a high frequency and a laminated coil component showing a good state without an open circuit or the like can be obtained.

INDUSTRIAL APPLICABILITY

The present invention can be used in a laminated coil component.

REFERENCE SIGNS LIST

1 laminated coil component
2 element assembly

2A coil unit arrangement layer
2B shape retention layer
3 coil unit
4, 5 coil conductor
6 external electrode

The invention claimed is:

1. A laminated coil component comprising:

an element assembly formed by laminating a plurality of insulation layers; and a coil unit formed inside the element assembly by a plurality of coil conductors, wherein the grain diameter of the coil conductor is 10 μm to 22 μm after baking is completed, wherein the element assembly includes at least a coil unit arrangement layer which has the coil unit arranged therein, wherein the coil unit arrangement layer is made from glass-ceramic, and wherein the glass-ceramic contains 86.7 weight % to 92.5 weight % of $SiO_2$ and 0.5 weight % to 2.4 weight % of $Al_2O_3$.

2. The laminated coil component according to claim 1, wherein a potassium coating layer is formed to cover the coil conductor.

3. The laminated coil component according to claim 1, wherein the grain diameter of the coil conductor is 11 μm to 18 μm after baking is completed.

4. The laminated coil component according to claim 1, wherein the coil unit arrangement layer is made from amorphous ceramics.

* * * * *